United States Patent [19]

Tobin, Jr.

[11] 4,159,550

[45] Jul. 3, 1979

[54] TOILET FACILITY

[75] Inventor: Leo W. Tobin, Jr., Darien, Conn.

[73] Assignee: American Standard Inc., New York, N.Y.

[21] Appl. No.: 826,495

[22] Filed: Aug. 22, 1977

[51] Int. Cl.[2] ..... E03D 1/00; E03D 3/00

[52] U.S. Cl. ..... 4/319; 4/421; 4/431

[58] Field of Search ..... 4/10, 69 R, 95, 96, 4/115, 76, 77, 12, 319, 421, 422, 431, 432; 29/782

[56] References Cited

U.S. PATENT DOCUMENTS

| | | | |
|---|---|---|---|
| 2,212,538 | 8/1940 | Groeniger | 4/69 |
| 2,414,964 | 1/1947 | McPherson | 4/10 |
| 2,435,845 | 2/1948 | Rice | 4/319 |
| 3,318,248 | 5/1967 | Rembold | 4/10 |
| 3,727,241 | 4/1973 | Drouhard et al. | 4/10 |
| 3,787,901 | 1/1974 | Wagner et al. | 4/10 |

*Primary Examiner*—Willis Little

*Attorney, Agent, or Firm*—James J. Salerno, Jr.; Robert G. Crooks

[57] ABSTRACT

A toilet facility for use in boats, campers, mobile homes, recreational vehicles, land and water cruisers, residences, basement flush up, and the like, is disclosed. The toilet facility utilizes a minimum amount of flush water and includes a modified water closet bowl of the siphon type, a sump tank, a macerator pump means, and a water closet tank. A macerator pump means is coupled in fluid communication between a holding tank or other disposal means and the sump tank. The macerator pump is electrically energized through a control circuit when the flush handle is tripped. The duration of the flush cycle may be controlled by a timing circuit which will automatically shut off the macerator pump. Also, the macerator pump may be shut off by the control circuit sensing that the flush cycle is complete, that is, when the macerator pump is pulling only air therethrough or when the control circuit senses the absence of water at the macerator pump inlet. All of the waste and contaminated water is evacuated from the bowl leaving clean, uncontaminated water in the bowl to provide a water seal after the flush cycle is completed and when the toilet facility is not in use. When the macerator pump is in operation, the water is drawn from the bowl through the pump and either into a holding tank or other waste disposal or treatment means.

6 Claims, 3 Drawing Figures

TOILET FACILITY

BACKGROUND OF THE INVENTION

1. Field of the Invention

This invention relates to a toilet facility for disposal of waste and more particularly to a toilet facility utilizing a minimum amount of flush water which is sufficient to wash the water closet bowl after each flush so that only clean uncontaminated water remains in the bowl after all of the waste is evacuated from the bowl.

2. Description of the Prior Art

In a conventional toilet facility of the siphon type, (either the siphon jet or siphon vortex), most of the water used to complete the flush cycle is required to start the siphoning action and to maintain the siphon until all waste material has been evacuated from the bowl. In the siphon jet bowl, flush water enters through rim holes and through the water jet opening positioned at the base of the chamber and siphonic action causes rapid withdrawal of water from the bowl and rids the bowl of its contents. In the siphon vortex bowl, flush water enters through punchings located around the bowl rim. The flow of water creates a whirling action, a vortex, that draws the contents into the bottom of the bowl and siphonic action rids the bowl of its contents.

A toilet facility of the recreational type which utilizes the combination of a water closet bowl, and a macerator pump means is known. U.S. Pat. Nos. 2,779,948 and 2,865,028 describe the use of a hand operated displacement pump or a suction pump in combination with a toilet bowl. U.S. Pat. No. 3,124,810 describes a sewage handling apparatus which includes a toilet bowl and a waste disposal unit having a timed flush action. U.S. Pat. No. 3,540,590 describes a waste treatment method and apparatus which utilizes a solid form of soluble chemical compound which is dissipated by the flow of purging liquid toward the waste receptacle. U.S. Pat. No. 3,593,345 describes a self-contained recirculating toilet having a self-cleaning pump and filter apparatus. U.S. Pat. No. 3,727,241 describes a sewage handling system which includes a toilet, a sewage pump for making a homogenious slurry with means incorporated therein to prevent cavitation. U.S. Pat. No. 3,787,901 describes a sewage handling system which utilizes a heater in the waste storage tank to evaporate the excess water. U.S. Pat. No. 3,878,569 describes a self-contained recreational toilet unit which includes a sewage macerator pump.

The foregoing prior art, while it describes various types of toilet facilities, including recreational toilet assemblies, does not suggest a toilet facility having a modified water closet bowl of the siphon type and which utilizes a minimum of flush water for a flush cycle to rid the bowl of its contents and effects a water seal of clean uncontaminated water after each flush. Also, the amount of water required to completely evacuate the waste from the water closet bowl and wash the bowl so that only clean uncontaminated water remains is substantially reduced to less than 50% of that which is required for a conventional water closet bowl of the siphon type.

SUMMARY OF THE INVENTION

It is an object of the invention to provide a toilet facility adapted for use on boats, campers, mobile homes, recreational vehicles, land and water cruisers as well as residential dwellings and the like.

An object of the invention is to provide a modified water closet bowl which does not require flush water to begin a flush cycle.

Another object of the invention is to provide a toilet facility which utilizes less than a gallon of water to complete a flush cycle and which can be used in basements where the sewer or waste outlet is above the water closet bowl.

It is another object of the invention to provide a modified water closet bowl of the siphon type in which the elimination of waste from the bowl requires about 10 to 15 seconds while utilizing about 2 quarts of water.

Another object of the invention is to provide a toilet facility in which the waste disposal lines may be less than an inch and may be made of flexible materials such as synthetic elastomers.

Another object of the invention is to provide a modified water closet bowl of the siphon type which does not utilize a siphonic action to rid the bowl of its contents.

Another object of the invention is to provide a toilet facility in which the component parts are readily available relatively simple to assemble and inexpensive to install.

The invention generally contemplates providing a toilet facility which includes a modified water closet bowl of the siphon type. The toilet facility is arranged and constructed without venting so that the water closet bowl can be evacuated of waste material and completely washed with clean water and to provide a water seal so that no contaminated water remains in the water closet bowl while utilizing a flush cycle of less than a gallon of water and preferably only about 2 quarts of water. The toilet facility includes a flush valve means coupled to the modified water closet bowl of the siphon type. The water closet bowl is mounted on a sump tank in fluid tight connection. A macerator pump means is mounted on the sump tank in fluid tight connection and is in fluid communication with the waste discharge outlet of the water closet bowl and a holding tank or other discharge means. A control circuit is operatively connected between the flush valve means and the macerator pump so that when the flush valve means is actuated, the macerator pump is electrically energized to begin the flush cycle and will stop when the flush cycle is complete.

DESCRIPTION OF THE PREFERRED EMBODIMENT

Figures 1, 2:
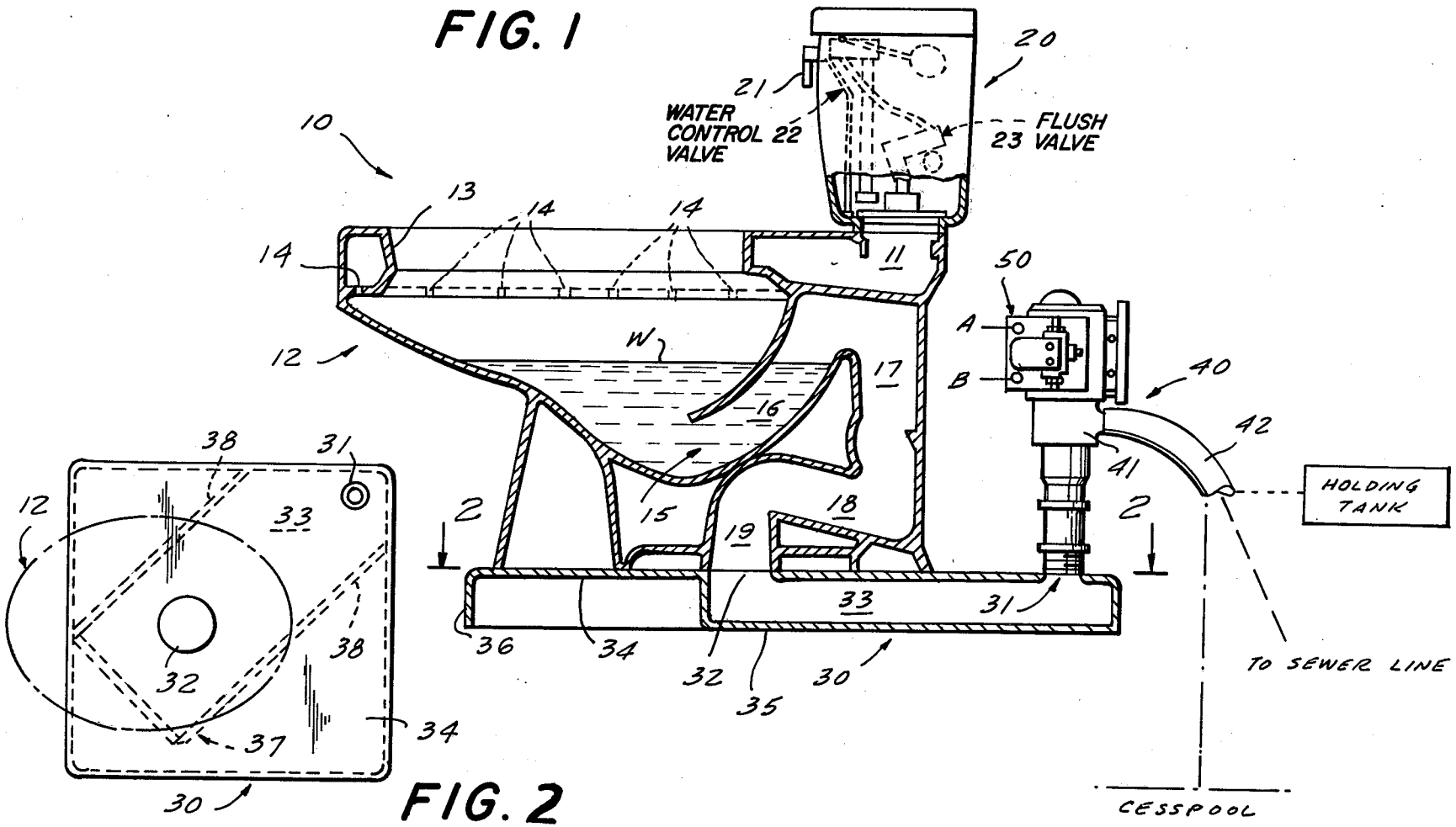
FIG. 1 is a side elevational view of the invention fully assembled with the holding tank or other discharge means, shown in dotted lines.
FIG. 2 is a sectional view taken along lines 2—2 of FIG. 1.

Referring now to FIGS. 1 and 2, there is illustrated a toilet facility 10 made in accordance with the present invention and includes a water closet bowl 12, a water closet tank 20, a sump tank 30 and a macerator pump means 40. Macerator pump means 40 is mounted on the sump tank 30 in fluid tight connection with sump waste outlet opening 31. Water closet bowl 12 is mounted in fluid tight connection with the sump inlet opening 32 of sump tank 30. Waste outlet 41 of macerator pump means 40 is coupled in fluid tight connection through flexible conduit 42 to a holding tank or other waste discharge means such as a cesspool, a holding tank, or sewer line shown in dotted line in FIG. 1. Macerator pumps, such as shown in FIG. 1, are available commercially such as is manufactured by the Oberdorfer Pump Division of Syracuse, New York, Model No. 209M which operates on 12 volt DC. The waste inlet of pump 40 is about 1½ inches in diameter and the waste outlet is about ¾ inch in diameter.

Water closet bowl 12 shown in FIG. 1 is a modified siphon type bowl in which the water jet chamber normally provided at the front of the bowl and the water jet opening at the bottom of the jet chamber has been eliminated to improve the operation of the system and also to reduce the amount of water required to complete one flush cycle. Hollow rim 13 extends around the top of bowl 12 and is in fluid communication with the water closet tank 20. All of the flush water is carried through the hollow rim and exits through rim wash holes 14 to wash the walls of the bowl and to carry away any waste remaining in the bottom of the bowl. Waste passageway 15 of bowl 12 is about 2 inches in diameter and is defined by up-leg of trap 16, down-leg of siphon 17, horizontal leg of trap 18 and bowl outlet 19. Bowl waste passageway 15 is in fluid tight communication with sump waste passageway 33 and flexible conduit 42 of macerating pump means 40. When water "W" is in bowl 12 and covers the opening of up-leg of trap 16 the system is closed and a water seal is provided.

Sump tank 30 shown in FIG. 2 may be made of metal, plastics, ceramic, or sheet steel and is in the form of a box having top and bottom surfaces, 34, 35, about 20 inches in length and about 15 inches in width. Side walls 36 are about 2 inches in height. A sump waste passageway 33 is defined by spaced parallel side walls 38, end walls 39, side walls 36, and top and bottom surfaces 34 and 35. Parallel walls 38 are spaced approximately 2 inches so that sump waste passageway 33 and bowl waste passageway are approximately equal in cross-sectional area. Water closet bowl 12 is mounted on top surface 34 in fluid tight connection and held in place by threaded studs and rubber seal, not shown. No vent is required between macerator pump means and bowl waste passageway 15. Also, where the facility is used in the basement of a dwelling and the waste disposal outlet is positioned above the water closet bowl, a check valve will be required to be mounted between macerator pump outlet 41 and the disposal outlet for the dwelling to prevent waste from flowing back through the macerator pump.

Water closet tank 20 is mounted on bowl water inlet opening 11 in the conventional manner. Tank 20 includes water control valve means 22 and flush valve means 23 as shown in dotted lines respectively such as is disclosed in U.S. Pat. No. 3,107,747 to Parkison and U.S. Pat. No. 2,773,268 to Hurko. Water closet tank lever handle 21 is operatively connected to the flush valve to permit discharge of flush water when required.

Figure 3:
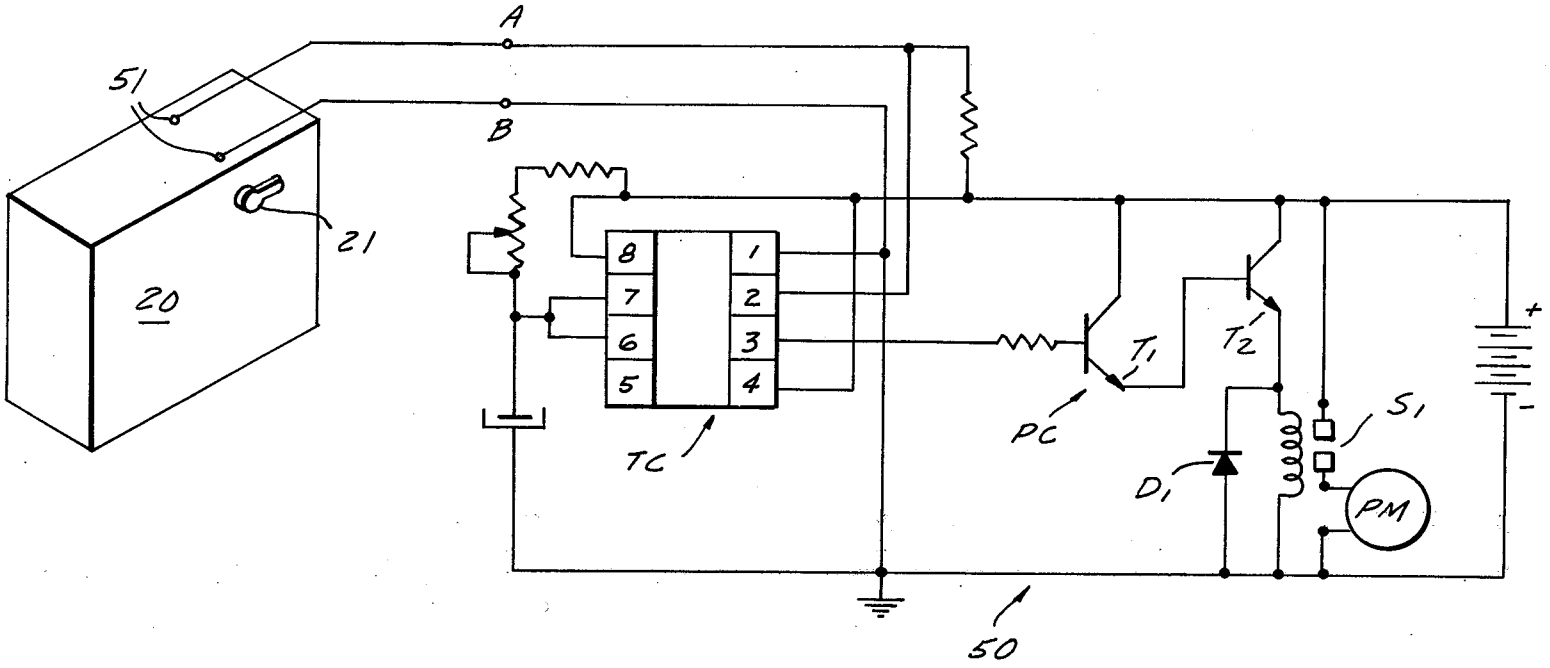
FIG. 3 is a schematic diagram of the circuit that can form a part of the assembly of FIG. 1.

Lever handle 21 is operatively coupled to a switch means, not shown and actuates the switch terminals 51 thereby electrically energizing control circuit 50 as depicted schematically in FIG. 3. Other means may be used to actuate macerator pump means such as mechanical or fluidic or electro-mechanical means. Control circuit 50 includes timing circuit TC and when energized may be set to operate from 1–15 seconds. Other means may be utilized to control the duration of the flush cycle, for example, it may be controlled through a vacuum switch which would start and stop the macerator pump by sensing the pressure differential in sump waste passageway 33. Also, the macerator pump may be shut off by the control circuit sensing that the flush cycle is complete, that is, when the macerator pump is pulling only air therethrough or when the control circuit senses the absence of water at the macerator pump inlet. Preferably, when timing circuit TC, which is a 555 timer integrated circuit, is energized, macerator pump circuit PC is simultaneously energized through driver transistor $T_1$ which supplies current through its emitter to power transistor $T_2$. Solenoid $S_1$ is closed which causes the pump motor PM of macerator pump means 40 to start pumping waste from bowl 12. It should be noted that no additional water is required to rid the bowl of its contents and since toilet facility 10 is a closed system when up-leg of trap 16 is covered with water "W" as shown in FIG. 1, macerator pump rapidly pumps all waste from the bowl without siphonic action. When lever handle 21 of tank 20 is tripped, water "W" from tank 20 starts to flow into hollow rim 13, simultaneously, the pump is energized and causes a rapid evacuation of any waste from bowl 12 by pumping action. As indicated above, since water covers the up-leg 16, the pump will draw all waste from the bowl by suction and not by a siphoning action whereby the additional water required in a conventional toilet facility to start the siphoning action is eliminated. The water entering bowl 12 through rim holes 14 washes the sides of the bowl and the remaining waste is pumped from the bowl. After the preset time has elapsed, timing circuit TC opens, thereby causing solenoid $S_1$ to open which stops motor PM from pumping. The flush valve automatically closes after less than one gallon of water has been used during the flush cycle so that a water seal of clean and uncontaminated water is provided in bowl 12. The water in tank 20 is replenished, the volume entering the tank is set by the adjustment of the float valve. In comparison, a standard siphon type water closet bowl requires about 13 to 20 quarts of water to complete one flush cycle.

Thus, the several aforenoted objects and advantages are most effectively attained. Although a preferred embodiment has been disclosed and described in detail herein, it should be understood that this invention is in no sense limited thereby and its scope is to be determined by that of the appended claims.

What is claimed is:

1. In a toilet facility of the type having a modified water closet bowl of the siphon type and which utilizes a minimum amount of flush water sufficient to wash the water closet bowl after each flush cycle so that only clean, uncontaminated water remains in the bowl after all waste is evacuated therefrom, said toilet facility comprising:

a hollow rim formed around the upper edge of said bowl, said hollow rim having a water inlet opening and a plurality of spaced outlet openings formed therein and disposed adjacent said bowl surfaces so that all water entering said hollow rim will pass through said outlet openings to wash said bowl surfaces;

flush valve means mounted in fluid tight connection with said water inlet opening of said hollow rim;

said bowl including an integrally formed up-leg having a bowl waste inlet opening and a down-leg having a bowl waste outlet opening so as to define a bowl waste passageway of the siphon type;

a sump tank having a waste passageway therein and waste inlet and waste outlet openings formed at each end respectively of said passageway;

said bowl mounted on said sump tank in fluid tight connection with said sump waste inlet opening and said bowl waste outlet opening so that said bowl waste passageway and said sump waste passageway are in fluid communication to provide a continuous waste passageway;

a macerator pump mounted on said sump tank in fluid tight connection with said sump waste outlet opening, said macerator pump having waste inlet and outlet openings;

actuating means operatively connected to said flush valve means for opening said flush valve to permit water to enter said hollow rim through said water inlet opening;

a control circuit including flush cycle control means electrically connected to said valve actuator means and said macerator pump so that when said flush valve is opened by said actuator means to permit water to enter said hollow rim through said water inlet opening, said flush cycle control means is electrically energized and simultaneously electrically energizes said macerator pump to pump waste rapidly from said bowl without siphonic action and is electrically deenergized when waste is removed from said bowl whereby a minimum of flush water of less than one gallon is utilized and is sufficient to wash the water closet bowl of waste so that only clean uncontaminated water remains in said bowl and provides a water seal when the flush cycle is completed, said control circuit including sensing means operably associated with said pump for shutting off said pump when only air is being pumped therethrough.

2. The toilet facility of claim 1 wherein the flush cycle control means is energized for a period of from 10 to 15 seconds.

3. The toilet facility of claim 1 wherein said flush cycle control means is energized for a period of 10 seconds.

4. The toilet facility of claim 1 wherein said toilet facility includes a water closet tank having a water outlet opening in the bottom thereof and mounted on said bowl in fluid tight communication with said hollow rim, said flush valve means mounted in said tank and normally closing said water outlet opening and a trip lever mounted on said tank and operatively coupled to said flush valve means.

5. The toilet facility of claim 4 wherein said control circuit includes an electric switch operably coupled to said trip lever so that said control circuit is electrically energized when said trip lever is actuated.

6. The toilet facility of claim 1 wherein the amount of water utilized to complete one flush cycle is about 2 quarts.

* * * * *